US006929135B1

(12) United States Patent
Hajianpour

(10) Patent No.: US 6,929,135 B1
(45) Date of Patent: Aug. 16, 2005

(54) STOPPER AND STRAW WITHIN A BOTTLE PREVENTING LEAKAGE AND PROVIDING FOR DRINKING A BEVERAGE

(75) Inventor: Zoya Hajianpour, Coral Springs, FL (US)

(73) Assignee: Zoya, Inc., Sunrise, FL (US)

( * ) Notice: Subject to any disclaimer, the term of this patent is extended or adjusted under 35 U.S.C. 154(b) by 0 days.

(21) Appl. No.: 10/648,738

(22) Filed: Aug. 26, 2003

(51) Int. Cl.[7] ..... B65D 39/00
(52) U.S. Cl. ..... 215/229; 215/388; 220/705
(58) Field of Search ..... 215/229, 388, 215/11.5; 220/705, 706, 707, 708, 709, 710, 220/714

(56) References Cited

U.S. PATENT DOCUMENTS

| | | | | | |
|---|---|---|---|---|---|
| 2,066,121 | A | * | 12/1936 | Morris | 215/229 |
| 3,291,331 | A | * | 12/1966 | Grisham et al. | 215/388 |
| 3,656,654 | A | | 4/1972 | Brinkley, III | |
| 4,519,529 | A | | 5/1985 | Seltz | |
| 4,733,785 | A | | 3/1988 | Turner, Jr. et al. | |
| 4,852,781 | A | * | 8/1989 | Shurnick et al. | 224/148.2 |
| 4,976,364 | A | | 12/1990 | Solomon | |
| 5,273,172 | A | | 12/1993 | Rossbach et al. | |
| 6,050,444 | A | * | 4/2000 | Sugg | 220/707 |
| 6,116,446 | A | | 9/2000 | Haughton et al. | |
| 6,123,219 | A | | 9/2000 | Cornell et al. | |
| 6,230,913 | B1 | * | 5/2001 | Cornell et al. | 215/387 |
| 6,290,090 | B1 | * | 9/2001 | Essebaggers | 220/710 |
| 6,375,019 | B1 | * | 4/2002 | Hirota et al. | 215/229 |
| 6,494,332 | B1 | | 12/2002 | Haughton et al. | |
| 6,523,711 | B1 | | 2/2003 | Hughes et al. | |

FOREIGN PATENT DOCUMENTS

| | | | | |
|---|---|---|---|---|
| JP | 2001-300 | * | 1/2001 | 215/388 |
| JP | 2004-238024 | * | 8/2004 | 215/388 |
| WO | WO 03/049583 A1 | * | 6/2003 | 215/388 |

* cited by examiner

*Primary Examiner*—Lien M. Ngo
(74) *Attorney, Agent, or Firm*—Ronald V. Davidge

(57) ABSTRACT

A bottle holding a beverage includes a straw and stopper combination that is moved into a deployed position within the neck of the bottle after the cap of the bottle is removed. In this position, an air path through the stopper provides for air flow into the bottle when suction is applied through the straw. When suction is not applied, the air path is closed by a flexible member of the stopper, so that the beverage cannot leak outward through the air path or through the straw.

14 Claims, 2 Drawing Sheets

STOPPER AND STRAW WITHIN A BOTTLE PREVENTING LEAKAGE AND PROVIDING FOR DRINKING A BEVERAGE

BACKGROUND OF THE INVENTION

1. Field of the Invention

This invention relates to an apparatus to be held within a bottle to provide for drinking a beverage from the bottle, and, more particularly, to such an apparatus additionally preventing leakage from the bottle in the event the bottle is knocked over or inverted.

2. Summary of the Background Art

U.S. Pat. No. 4,733,785 describes a bottle having a tapered neck portion, holding a beverage and a combination straw and mini-buoyant chamber designed to float upward into the neck of the bottle when the cap is removed and to be held therein by contact with the neck of the bottle. The combination of the straw and the mini-buoyant chamber, which carries an advertising message on its exterior surface, can be removed from the bottle with a firm pull. The opening within the neck of the bottle is round, while the mini-buoyant chamber is non-circular, so that an air passage is formed for admitting air around the mini-buoyant chamber as the beverage is sucked out through the straw. What is needed is a way to block this air passage when suction is not being applied through the straw, so that the beverage cannot spill out through the air passage when the bottle, having been opened, is accidentally knocked over or inverted.

U.S. Pat. No. 3,656,654 describes a combination of a beverage container and a drinking tube with means to present the tube for use upon opening the container. A drinking tube for use with a beverage container having a lid with a tear-out strip is an elongate tubular member having a length at least equal to an internal diagonal dimension of the container and an upper end portion thereof engaged by a positioning member mounted on the tear-out strip that guides the upper end portion through an opening in the lid formed by removal of the tear-out strip. A float member is mounted on the tubular member for raising the upper end of the tubular member through the opening in the lid. Again, what is needed is a way to block the air passage through the opening in the lid around the straw when suction is not being applied through the straw, to prevent the spilling of beverage from the container if the container is knocked over or dropped.

U.S. Pat. Nos. 6,116,446 and 6,494,322 describe a stopper for use with an individual beverage container is disclosed. The stopper has a generally tubular side wall with an upper edge and a lower edge. The side wall is dimensioned to In snugly in the neck of the beverage container with a pressure fit. A bottom extends inwardly from the side wall. A flat upper portion is integrally attached to the bottom and is spaced upwardly from the bottom. An aperture is formed in the bottom or the flat upper portion. In addition, a vent hole is formed in the bottom or the flat upper portion. Preferably, the fiat upper portion is spaced from the side walls thereby forming a trough therebetween. Preferably the aperture is formed in the bottom and dimensioned to receive a straw snugly therethrough. Preferably the flat upper portion is divided into a first and second upper portion with a channel therebetween, with the channel being contiguous with the aperture and dimensioned to receive an upper portion of the straw when in a stored position. In an alternate embodiment the aperture and vent hole are formed between the side wall and the neck of the bottle. What is needed is a valve member closing the vent hole when suction is not provided through the straw, so that beverage is not spilled when the container is knocked over or dropped.

U.S. Pat. No. 6,123,239 describes a straw assembly disposed within a beverage container and adapted for use with various positioning mechanisms. A positioning mechanism is slidably lockable along the length of the straw for appropriately positioning the straw in the opening of the container. Again, what is needed is a venting mechanism opening only when suction is applied to the container through the straw.

U.S. Pat. No. 6,523,711 describes a sports bottle cap having a pressure differential valve allowing water to flow out through the bottle cap only when the bottle is inverted and squeezed, or, alternately, when a straw is threaded through the pressure differential valve, deactivating it, and attached to the bottle cap, allowing the user to draw beverage from the bottle. The bottle cap additionally includes an umbrella valve operating as a one-way valve that remains collapsed flat against the bottom surface of an inlet air passage when the bottle is squeezed, but that opens easily as air pushes against it when the bottle is released. Essentially, it opens the same way as an umbrella would inappropriately collapse if pointed away from the wind. Another advantage of the umbrella valve is that it quickly returns air into the bottle so that the user is able to drink rapidly without having to wait for air to return through the differential valve, through a filter if one is used, or through a straw tube if one is used. What is needed is a simple stopper mechanism that can be shipped within a sealed bottle for deployment when the bottle is opened, having a simple flapper-type one-way valve to provide only for air return during suction from the bottle through the straw.

U.S. Pat. No. 5,273,172 describes a closure device mounted at the top of an open beverage container by a sealing device extending down into the bottle. A top part of the closure device includes a semi-circular portion having a groove, with beverage-emitting and air-admitting holes being positioned in the base of the groove. A pivotally movable cap is mounted on the top part covering the groove. When the cap is closed, it causes a flexible hose mounted in the beverage-emitting hole to bend, closing the hose and also moving the hose into position to block the air-admitting hole. In this way, leakage of the beverage is prevented when the pivotally movable cap is closed. What is needed is a valve preventing leakage when the bottle is knocked over or dropped, even when the pivotally movable cap is left open.

SUMMARY OF THE INVENTION

In accordance with a first aspect of the invention, apparatus is provided for holding and dispensing a beverage. The apparatus includes a bottle, a cap, a straw, and a stopper. The bottle, which holds the beverage, includes an opening and a neck extending downward from the opening. The cap covers the opening of the bottle. The straw is held within the bottle, and the stopper is held on the straw within the bottle, with an upper portion of the straw extending upward from the stopper and a lower portion of the straw extending downward from the stopper. The stopper and straw are movable together with the cap removed from the bottle into a deployed position, with the stopper disposed within the neck of the bottle and with the upper portion of the straw extending outward from the bottle. The stopper includes a flexible structure holding the stopper within the neck of the bottle in the deployed position, an air path extending through the stopper, a straw hole through which said straw extends, and a flexible member moving into an open position to admit air into the bottle through the air path with the stopper in the deployed position when suction is applied to the bottle through the straw and closing to prevent the movement of air and of the beverage through the air path with the stopper in the deployed position when suction is not applied to the bottle through the straw.

The stopper may include a core extending around the straw hole and a lower flange extending outward from the core to form the flexible member, so that a periphery of the lower flange contacts an adjacent surface of the bottle with the stopper in the deployed position when suction is not applied to the bottle through the straw. Then, when suction is applied to the bottle through the straw, the periphery of the lower flange is moved away from the adjacent surface of the bottle with the stopper in the deployed position.

Alternately, the stopper includes an upper section having an upper surface, a flat lower surface extending along a portion of the upper section, and a hole extending through the upper section between the upper surface and the lower surface to form a portion of the air path. The flexible structure extends below the lower surface, being held against the lower surface in the closed position and moved away from the lower surface in the open position.

DETAILED DESCRIPTION OF THE INVENTION

Figure 1:
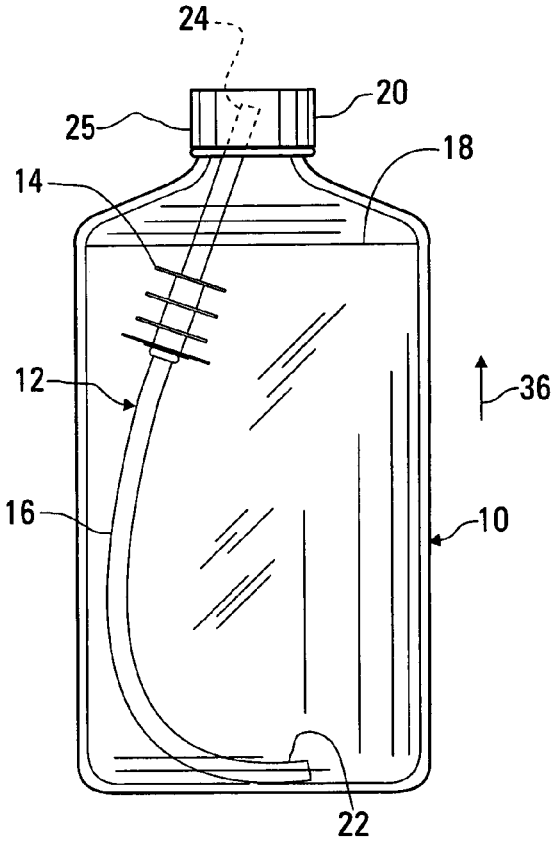
FIG. 1 is a side elevation of a bottle including a stopper and straw combination in a closed configuration, made in accordance with a first embodiment of the invention.

FIG. 1 is a side elevation of a bottle 10 made in accordance with a first embodiment of the invention to include a combination 12 of a stopper 14 and a straw 16. The bottle 10 is preferably filled with a beverage 18 for drinking sealed with a cap 20, which may be the tamper-evident type including a lower ring that breaks away from the cap when the bottle is opened. Since the straw 16 is too long to fit within the bottle 10 in a straightened condition, the lower portion of the straw 16 is deflected into a curved condition within the bottle 10, with the upper end 24 of the straw 16 being held downward by the cap 20.

Figure 2:
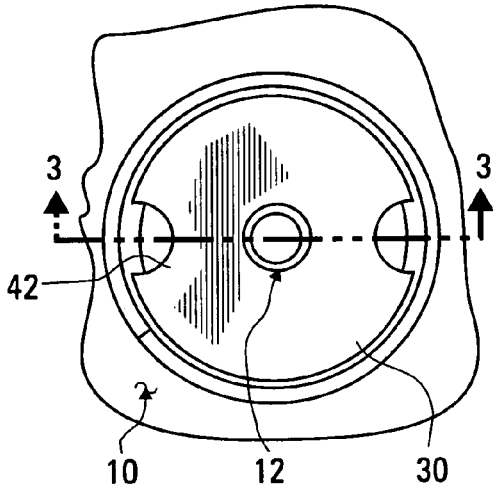
FIG. 2 is a fragmentary plan view of the bottle of FIG. 1 with the stopper and straw in a deployed configuration.
Figure 3:
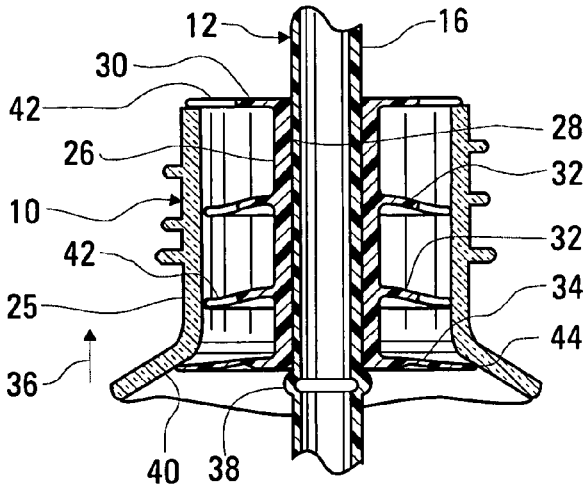
FIG. 3 is a fragmentary cross-sectional elevation of the bottle configured as in FIG. 2, taken as indicated by section line 3—3 in FIG. 2.

When the cap 20 is removed, the upper portion 24 of the straw 16 moves upward and outward from the bottle 10, with the stopper 14 being moved toward the neck 26 of the bottle 10, by an upward force arising within the deflected lower portion 22 of the straw 22. When this motion occurs, the upper end 24 of the straw 16 is easily grasped to move the straw and stopper combination 12 into a fully deployed position, with the stopper 14 held within the neck 25 of the bottle 10 as shown in FIGS. 2 and 3. FIG. 2 is a fragmentary plan view of the bottle 10 with the combination 12 in this deployed position, while FIG. 3 is a fragmentary cross-sectional elevation thereof, taken as indicated by section line 3—3 in FIG. 2.

The stopper 14 includes a cylindrical core 26, having a hole 28 through which the straw 16 extends, and several flanges extending outward from the cylindrical core 26, including an upper flange 30, a pair of intermediate flanges 32, and a lower flange 34. The flanges 30, 32 are sized so that they deflect downward as the stopper 14 is pulled upward, in the direction of arrow 36, within the neck 25 of the bottle 10. In this way, the flanges 32 provide a resilient structure holding the stopper 14 in place within the neck 25 of the bottle 10. Preferably, the user pulls the upper end 24 of the straw until the upper flange 30 emerges from the bottle 10. The straw 16 optionally includes an outwardly extending section 38 to help transmit a pulling force between the straw 16 and the stopper 14 without excessive slippage. This upward movement of the stopper 14 also moves the lower flange 34 into contact with an adjacent surface 40 of the bottle 10.

In accordance with the invention, an air path is provided through the stopper 14 to allow for the inward flow of air into the bottle 10 as the user sucks the beverage 18 from the bottle 10 through the straw 16. Additionally, in accordance with the invention, this air path is opened by means of the application of suction through the straw 16 and otherwise closed to prevent the outward flow of the beverage 18 if the bottle 10 is dropped or turned over. Specifically, the air path is provided by notches 42 within the upper flange 30 and within each of the intermediate flanges 32. The lower flange 34 is not notched in this way; rather its periphery 44 contacts the adjacent bottle surface 40 to block the outward flow of the beverage 18 from the bottle 10 when suction is not being applied through the straw 16. On the other hand, when suction is applied through the straw 16, the lowering of air pressure within the bottle 10 below the lower flange 34 causes this flange 34 to deflect downward so that a passage is opened between the periphery 44 of the lower flange 34 and the adjacent bottle surface 40. In this way, the lower flange 34 acts as a flexible valve member closing against the adjacent bottle surface 40 to form a one-way valve, or check valve, opening to allow the passage of air only when suction is applied within the bottle 10. Preferably, the lower flange 34 is reduced in thickness and increased in diameter compared to the other flanges 30, 32. Preferably, the stopper 14 is composed of an integral molded flexible thermoplastic resin, such as polyethylene.

When the bottle 10 is turned on its side or inverted without the application of suction through the straw 16, the beverage 18 does not flow outward around the lower flange 34 because this flange is held in a sealed condition against the adjacent bottle surface 40. Furthermore, under these conditions, the beverage 18 dies no flow outward through the straw 16 because air is not allowed to flow into the bottle 10 past the lower flange 34.

Figure 4:
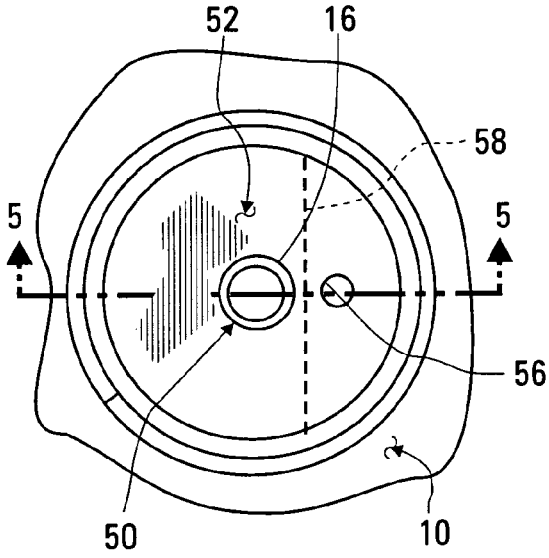
FIG. 4 is a fragmentary plan view of a bottle having a stopper and straw made in accordance with a second embodiment of the invention.
Figure 5:
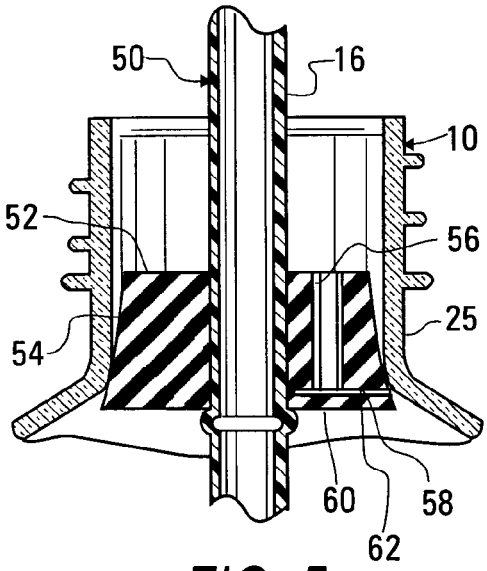
FIG. 5 is a fragmentary cross-sectional elevation of the bottle as shown in FIG. 4, taken as indicated by section line 5—5 therein.

A second embodiment of the invention will now be explained, with particular reference being made to FIGS. 4 and 5. FIG. 4 is a fragmentary plan view of the bottle 10 having a combination 50 of the straw 16, as previously described, with like parts being accorded like reference numerals, and a first alternative stopper 52. FIG. 5 is a fragmentary cross-sectional elevation of the bottle as shown in FIG. 4, taken as indicated by section lines 5—5 therein.

The first alternative stopper 52 includes a tapered peripheral surface 54 forming a resilient structure holding the stopper 52 in place within the neck 25 of the bottle 10. An air path through the stopper 52 includes a hole 56 extending upward from a narrow slot 58 extending outward to the peripheral surface 54. Below the slot 58, a flexible flap 60 closes the air path by holding the slot 58 closed when suction is not applied within the bottle 10 through the straw 16. When suction is applied through the straw 16, the flap 60 is pulled downward, opening the slot 58 so that air can flow inward from the hole 56. In this way, the flap 60 acts as a flexible valve member in a one-way valve, or check valve, operating against an intermediate surface 62 of the stopper 52 at the top of the slot 58.

Preferably, the stopper 52 is composed of a molded elastomeric material, such as a silicone rubber, with the slot 58 being formed as a part of the molding process or alternately being cut into the part after the molding process.

Figure 6:
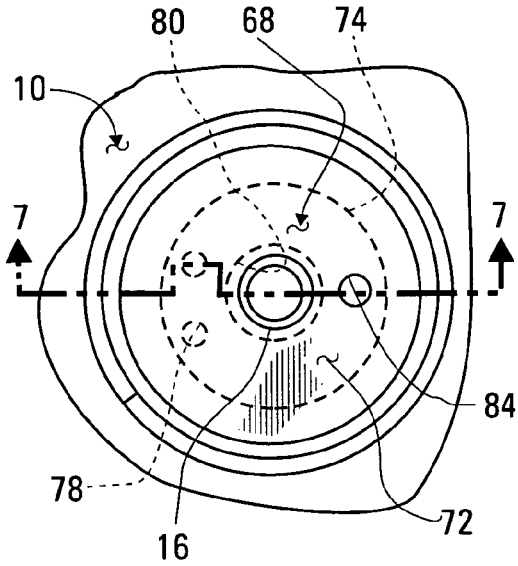
FIG. 6 is a fragmentary plan view of a bottle having a stopper and straw made in accordance with a third embodiment of the invention.
Figure 7:
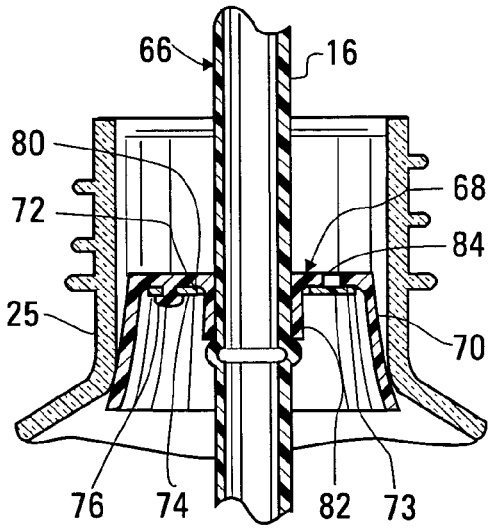
FIG. 7 is a fragmentary cross-sectional elevation of the bottle as shown in FIG. 6, taken as indicated by section line 7—7 therein.

A third embodiment of the invention will now be discussed, with particular reference being made to FIGS. 6 and 7. FIG. 6 is a fragmentary plan view of the bottle 10 having a combination 66 of the straw 16, as previously described, with like parts again being accorded like reference numerals, and a second alternative stopper 68. FIG. 7 is a fragmentary cross-sectional elevation of the bottle as shown in FIG. 6, taken as indicated by section lines 7—7 therein.

The second alternative stopper 68 includes a tapered flexible section 70 forming a resilient structure holding the stopper 68 in place within the neck 25 of the bottle 10. The stopper 68 also includes an upper section 72 providing a flat lower surface 73 against which a flexible valve member 74 is held by means of studs 76 extending downward through holes 78 in the valve member 74. The valve member 74 also includes a hole 80 through which a central hub 82 of the stopper 68 extends. After the valve member 74 is placed against the surface 73 with the studs 76 extending through holes 78, these studs 76 are upset into a flattened condition by the local application of heat or by the local application of ultrasonic vibration. Both the valve member 74 and the portion of the stopper 68 including the upper section 72 and the tapered flexible section 70 are preferably composed of thermoplastic resins, such as polyethylene.

The air path through the stopper 68 includes a hole 84 extending through the upper section 72. When suction is not applied to the bottle 10 through the straw 16, the valve member 74 is held against the flat lower surface 73 so that beverage cannot pass outward from the bottle 10 through the hole 84. When suction is applied to the bottle 10 through the straw 16, the flexible valve member 74 is pulled downward, so that air flows inward through the hole 84 and through the resulting space between the flat lower surface 73 and the flexible valve member 74.

The first alternative stopper 52 and the second alternative stopper 68 are supplied within the bottle 10 assembled with the straw 16 in the manner described above in reference to FIG. 1. Preferably, each of the stoppers 14, 52, 68 can be removed with the straw 16 so that someone not wanting to use these assemblies can drink the beverage without them.

While the straw has been described as separate from the stopper 14, 52, 68, it is understood that these stoppers may be molded as integral pieces including the straws. While the invention has been described in its preferred embodiments with some degree of particularity, it is understood that this description has been given only by way of example, and that many variations can be formed without departing from the spirit and scope of the invention, as defined in the appended claims.

What is claimed is:

1. Apparatus for holding and dispensing a beverage, wherein said apparatus comprises:

a bottle, holding the beverage, including an opening and a neck extending downward from the opening;

a cap covering the opening of the bottle;

a straw held within the bottle; and a stopper held on the straw within the bottle, wherein an upper portion of the straw extends upward from the stopper, a lower portion of the straw extends downward from the stopper, the stopper and straw are movable together with the cap removed from the bottle into a deployed position with the stopper disposed within the neck of the bottle and with the upper portion of the straw extending outward from the bottle, the stopper includes a flexible structure holding the stopper within the neck of the bottle in the deployed position, an air path extending through the stopper, a straw hole through which said straw extends, and a flexible member moving into an open position to admit air into the bottle through the air path with the stopper in the deployed position when suction is applied to the bottle through the straw and closing to prevent the movement of air and of the beverage through the air path with the stopper in the deployed position when suction is not applied to the bottle through the straw.

2. The apparatus of claim 1, wherein said lower portion of said straw is deflected within said bottle as said upper portion is held down by said cap on said bottle, and said upper portion of said straw moves upward through said opening of said bottle when said cap is removed from said bottle.

3. The apparatus of claim 1, wherein said straw includes an outward extending bulge preventing upward movement of said straw through said stopper.

4. The apparatus of claim 1, wherein said straw and said stopper are formed as portions of an integral molded part.

5. The apparatus of claim 1, wherein said flexible structure deflects to permit said straw and said stopper to be pulled outward together through said opening of said bottle.

6. The apparatus of claim 1, wherein said stopper includes a core extending around said straw hole and a lower flange extending outward from said core to form said flexible member, a periphery of the lower flange contacts an adjacent surface of said bottle with said stopper in said deployed position when suction is not applied to said bottle through said straw, and said periphery of the lower flange is moved away from the adjacent surface of said bottle with said stopper in said deployed position when suction is applied to said bottle through said straw.

7. The apparatus of claim 6, wherein said stopper additionally includes at least one intermediate flange having an aperture within said air path extending outward from said core to form said flexible structure.

8. The apparatus of claim 7, wherein said stopper additionally includes an upper flange having an aperture within said air path extending outward from said core and above said opening with said stopper in said deployed position.

9. The apparatus of claim 6, wherein said stopper is composed of a molded flexible thermoplastic resin.

10. The apparatus of claim 1, wherein said stopper includes an upper section having an upper surface, a flat lower surface extending along a portion of said upper section, and a hole extending through said upper section between said upper surface and said lower surface to form a portion of said air path;

said flexible structure extends below said lower surface, being held against said lower surface in said closed position and moved away from said lower surface in said open position.

11. The apparatus of claim 10, wherein said flexible member is formed as an integral portion of a part including said upper section.

12. The apparatus of claim 11, wherein said stopper is composed of an elastomer and said stopper includes a tapered periphery forming said flexible structure.

13. The apparatus of claim 10, wherein said flexible member is formed as a part separate from said upper section and attached to extend below said upper section.

14. The apparatus of claim 10, wherein said upper section is composed of a thermoplastic resin, and said flexible structure is composed of a tapered flexible section of said stopper integral with said upper section.

* * * * *